US006401693B1

(12) United States Patent
Spanos et al.

(10) Patent No.: US 6,401,693 B1
(45) Date of Patent: Jun. 11, 2002

(54) PRESSURE SPIKE ATTENUATOR FOR AUTOMOTIVE FUEL INJECTION SYSTEM

(75) Inventors: Gary P. Spanos, Lynchburg; Jeffrey A. Schultz, Pittsville, both of VA (US)

(73) Assignee: Schrader-Bridgeport International, Inc., Buffalo Grove, IL (US)

( * ) Notice: Subject to any disclaimer, the term of this patent is extended or adjusted under 35 U.S.C. 154(b) by 0 days.

(21) Appl. No.: 09/654,460

(22) Filed: Sep. 1, 2000

(51) Int. Cl.[7] ..... F02M 37/04
(52) U.S. Cl. ..... 123/467
(58) Field of Search ..... 123/467, 510, 123/511, 447, 458; 138/30; 137/870, 872; 251/50

(56) References Cited

U.S. PATENT DOCUMENTS

| | | | | | |
|---|---|---|---|---|---|
| 4,605,166 | A | | 8/1986 | Kelly | |
| 4,709,679 | A | | 12/1987 | Djordjevic et al. | |
| 4,784,102 | A | | 11/1988 | Igashira et al. | |
| 4,784,322 | A | | 11/1988 | Daly | |
| 4,877,187 | A | | 10/1989 | Daly | |
| 4,962,887 | A | | 10/1990 | Matsuoka | |
| 4,964,391 | A | * | 10/1990 | Hoover | 123/510 |
| 5,213,083 | A | | 5/1993 | Glassey | |
| 5,365,906 | A | * | 11/1994 | Deweerdt | 123/467 |
| 5,421,306 | A | * | 6/1995 | Talaski | 123/510 |
| 5,477,829 | A | * | 12/1995 | Hassinger et al. | 123/467 |
| 5,603,302 | A | * | 2/1997 | Minagawa et al. | 123/456 |
| 5,623,910 | A | * | 4/1997 | Riggle | 123/510 |
| 5,701,869 | A | * | 12/1997 | Richardson et al. | 123/497 |
| 5,706,785 | A | * | 1/1998 | Radermacher et al. | 123/457 |
| 5,711,275 | A | * | 1/1998 | Minagawa et al. | 123/458 |
| 5,720,318 | A | | 2/1998 | Nagarajan et al. | |
| 5,727,525 | A | | 3/1998 | Tsuzuki | |
| 6,079,450 | A | * | 6/2000 | Onishi et al. | 138/30 |
| 6,135,092 | A | * | 10/2000 | Schaenzer et al. | 123/456 |
| 6,209,525 | B1 | * | 4/2001 | Konishi et al. | 123/467 |
| 6,230,684 | B1 | * | 5/2001 | Furuhashi et al. | 123/467 |
| 6,279,544 | B2 | * | 8/2001 | Rumpf | 123/458 |

* cited by examiner

*Primary Examiner*—Thomas N. Moulis
(74) *Attorney, Agent, or Firm*—Brinks Hofer Gilson & Lione

(57) ABSTRACT

A fuel injection system for an internal combustion engine includes a pressure spike attenuator that is installed between the pump and fuel rail inlet of the system. This pressure spike attenuator includes an expandable pressure vessel having a sidewall that is corrugated in cross-section to facilitate volumetric expansion of the pressure vessel. A solenoid valve includes a tapered needle that is moved between an opened and a closed position. In the opened position, the fuel pump, the pressure vessel, and the fuel rail are all in fluid communication with one another. In the closed position, the pressure vessel is isolated from both the fuel pump and the fuel rail, and the fuel rail is isolated from both the fuel pump and the pressure vessel.

18 Claims, 1 Drawing Sheet

PRESSURE SPIKE ATTENUATOR FOR AUTOMOTIVE FUEL INJECTION SYSTEM

BACKGROUND

The present invention relates to automotive fuel injection systems, and in particular to a system for improving fuel pressure control in such systems.

Modern high-pressure fuel injection systems use a pump that provides high-pressure fuel to a fuel rail for distribution to fuel injectors. Positive displacement pumps are often used, and such pumps typically provide pressure spikes in the pressurized fuel supply to the fuel rail. Such spikes can have an adverse impact on the precision with which the fuel injectors meter fuel into the engine.

Furthermore, in the event an automotive engine is not used for a substantial time period, leakage in the pump and/or one or more injectors can reduce pressure in the fuel rail undesirably. In this case, it will typically take some time for pressure to be restored in the fuel rail, and engine starting may be adversely affected during this time.

The present invention is directed to an improved fuel pressure control system that largely overcomes the disadvantages described above.

SUMMARY

By way of introduction, the preferred embodiment described below provides a pressure spike attenuator in an automotive fuel injection system. This pressure spike attenuator is preferably installed between the pump and the inlet to the fuel rail, and the attenuator includes an expandable pressure vessel, preferably of the type that includes a corrugated side wall that facilitates volumetric expansion of the pressure vessel. This pressure vessel is provided with a spring force over a differential volume selected to be adequate to substantially attenuate pressure spikes in the pressurized fuel supplied by the pump.

The embodiment described below includes a solenoid valve that in the open state allows fuel from the fuel pump to move between the pump and the pressure vessel as well as between the pump and the fuel rail. When closed, valve isolates the pump from both the pressure vessel and the fuel rail. Additionally, when closed the valve isolates the pressure vessel from the fuel rail. In this state, leakage in the pump and/or the injectors may depressurize the fuel line between the pump and the pressure vessel as well as the fuel rail, but such leakage will not depressurize the pressure vessel. When it is desired to start the vehicle the valve is opened, and the pressurized fuel of the pressure vessel is instantaneously available to pressurize the fuel rail and provide prompt engine starting.

The foregoing paragraphs have been provided by way of introduction, and they are not intended to limit the scope of the following claims.

DETAILED DESCRIPTION OF THE PRESENTLY PREFERRED EMBODIMENTS

Figure 1:
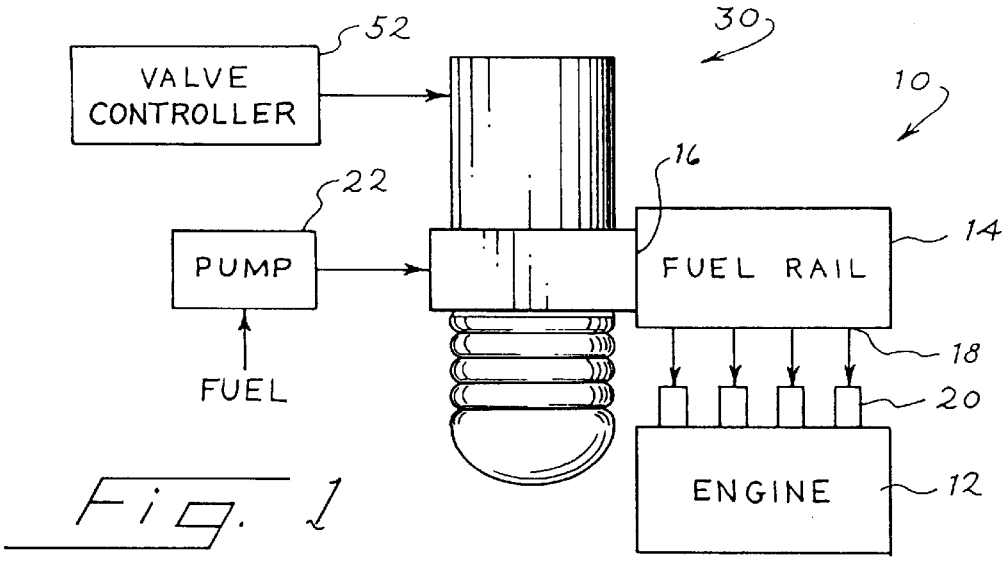
FIG. 1 is a block diagram of an automotive fuel injection system that incorporates a preferred embodiment of this invention.

Turning now to the drawings, FIG. 1 shows an automotive fuel injection system 10 that incorporates a preferred embodiment of this invention. The fuel injection system 10 is installed on an internal combustion engine 12, and the system 10 includes a fuel rail 14 with a fuel inlet 16 and multiple fuel outlets 18. Each of the fuel outlets 18 is connected to a respective fuel injector 20. Pressurized fuel is supplied to the fuel rail 14 by a pump 22, which is typically a high-pressure pump operating at an output pressure of 1800 to 2200 psi.

The elements 12 through 22 described above are conventional, and they can take any suitable form. Thus, this invention is not limited to use with any particular type of fuel rail 14, injectors 20, or pump 22.

As shown in FIG. 1, the system 10 also includes a fuel pressure control system 30 that is mounted between the pump 22 and the fuel rail 14. In order to minimize the number of hydraulic connections, it is preferable to mount the fuel pressure control system 30 to either the fuel rail 14 as shown in FIG. 1 or alternatively to the pump 22. Of course, the fuel pressure control system 30 can be mounted at other places, if desired, such as in the fuel line that interconnects the pump 22 and the fuel rail 14.

Figure 2:
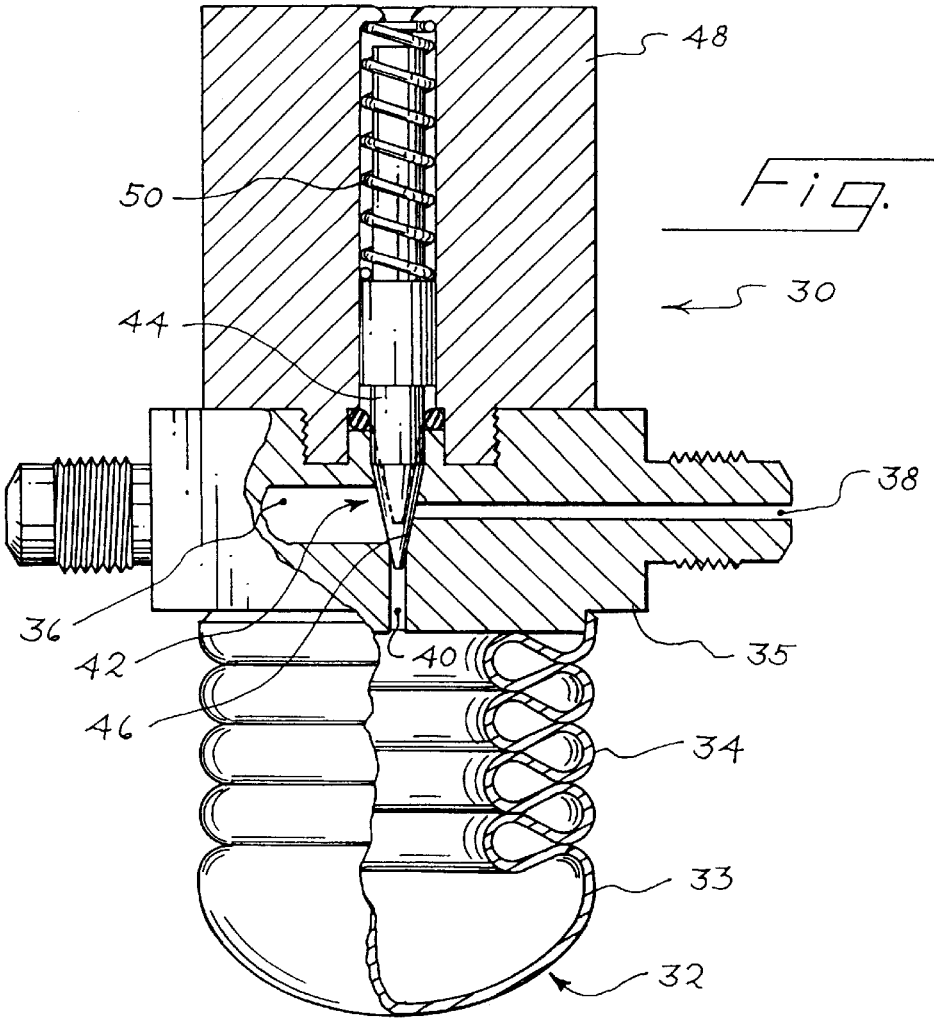
FIG. 2 is an enlarged view of the fuel pressure control system of FIG. 1.

As shown in FIG. 2, the fuel pressure control system 30 includes a pressure spike attenuator 32 that in this embodiment includes a bellows-type expandable pressure vessel 33. This pressure vessel 33 has corrugated side walls 34 and is formed of a suitable metal, such as stainless steel 304 for example. The pressure vessel 33 is capable of withstanding the high pressure supplied by the pump 22 of FIG. 1, yet the pressure vessel 33 is readily expandable to increase in volume in response to fuel pressure spikes, thereby attenuating the spikes.

The expandable pressure vessel 33 is secured to a body 35, as for example by welding. This body 35 includes an inlet 36 that is connected to the pump 22 of FIG. 1 and an outlet 38 that is connected to the fuel rail inlet 16 of FIG. 1. Additionally, the body 35 defines a port 40 that is in fluid communication with the interior of the pressure vessel 33.

The fuel pressure control system 30 also includes a valve 42 such as the illustrated solenoid valve. The valve 42 includes a tapered needle 44 that is moved vertically in the view of FIG. 2 by a solenoid coil 48 and a spring 50. The spring 50 normally biases a tapered needle 44 downwardly in the view of FIG. 2 to the position shown in solid lines, in which the tapered needle 44 is held in contact with a tapered value seat and seals the port 40 and the outlet 38. In response to an applied electrical voltage switched by the valve controller 52 of FIG. 1, the solenoid coil 48 moves the tapered needle 44 upwardly to the position shown in dotted lines in FIG. 2. In this open position, the inlet 36 is in fluid communication with both the outlet 38 and the port 40, and the outlet 38 is in fluid communication with the port 40. Thus, the valve 14 simultaneously performs two functions when it closes: (1) it seals the port 40 into the pressure vessel 33, thereby preserving a substantial volume of pressurized fuel, even in the event pressure in the inlet 36 falls due to pump leakage and/or pressure in the outlet 38 falls due to injector leakage; and (2) it seals the outlet 38, thereby preserving fuel pressure in the fuel rail, even in the event of pump leakage.

The fuel control system 30 provides a number of important advantages. As described above, it attenuates pressure spikes generated by the pump 22 and preserves a more nearly constant pressure in the fuel rail 14. This is achieved without introducing additional seals, in view of the fact that the pressure vessel 33 and in particular the corrugated side wall 34 extend longitudinally to increase the volume of the pressure vessel and contract longitudinally to reduce the volume of the pressure vessel without sliding seals of any type. The pressure vessel 33 has a differential volume that is adequate to allow a single pressure vessel 33 to stabilize the fuel pressure for the entire fuel rail. This provides cost advantages, since one pressure vessel 33 is used for multiple injectors.

Also, hydraulic fittings are minimized because the body 35 is secured directly either to the pump 22 or the fuel rail 14. The solenoid valve provides secure, metal-to-metal seals to seal the pressure vessel 33 and to seal the inlet 16 of the fuel rail 14 with a single valve element (the tapered needle 44). The entire system 30 is an integrated assembly that can be tested prior to installation.

By way of example, the following details of construction are provided in order better to define the best mode of this invention. These details of construction are in no way intended to be limiting. In this embodiment, the pressure vessel 33 has a diameter of 51 millimeters and a minimum longitudinal extent of 51 millimeters, as does the solenoid coil 48. The inlet 36 of the body 35 has a diameter of about 7 millimeters, and the diameter of the inlet 36 is greater than the diameter of the outlet 38.

As used here in the term "position" is intended broadly to encompass a range of positions. Thus, the open position of the tapered needle can be anywhere within a selected range of positions.

The term "actuator" is intended broadly to encompass devices for moving a valve member such as a tapered needle. The solenoid coil and the spring described above are examples of actuators.

The term "outlet" and "inlet" are used to denote the predominant direction of flow. It should be understood that there will typically be some degree of reverse flow. Thus, the fuel rail inlet may accommodate some limited flow of fuel out of the fuel rail toward the attenuator.

Of course, it should be understood that many changes and modifications can be made to the preferred embodiment described above. For this reason, this detailed description is intended by way of illustration and not by way of limitation. It is only the following claims, including all equivalents, that are intended to define the scope of this invention.

What is claimed is:

1. In combination with a fuel injection system for an internal combustion engine, said fuel injection system comprising a fuel rail comprising an inlet and a plurality of outlets; a plurality of fuel injectors, each coupled with a respective one of the fuel rail outlets; and a pump coupled with the fuel rail inlet to supply pressurized fuel to the injectors via the fuel rail, a fuel pressure control system comprising:

a pressure spike attenuator coupled with the fuel pump between the fuel pump and the fuel rail inlet;

a valve disposed between the pump and the attenuator and operative (1) to selectively block fluid flow in both directions between the pump and the attenuator when the valve is closed and (2) to selectively allow fluid flow in both directions between the pump and the attenuator when the valve is opened.

2. In combination with a fuel injection system for an internal combustion engine, said fuel injection system comprising a fuel rail comprising an inlet and a plurality of outlets; a plurality of fuel injectors, each coupled with a respective one of the fuel rail outlets; and a pump coupled with the fuel rail inlet to supply pressurized fuel to the injectors via the fuel rail, a fuel pressure control system comprising:

a pressure spike attenuator coupled with the fuel injection system between the pump and the fuel rail inlet, said attenuator configured to attenuate pressure spikes generated by the pump and thereby to stabilize pressure in the fuel rail;

a valve disposed between the pump and the attenuator and operative (1) to selectively block fluid flow in both directions between the pump and the attenuator when the valve is closed and (2) to selectively allow fluid flow in both directions between the pump and the attenuator when the valve is opened.

3. The invention of claim 1 or 2 wherein the valve comprises a solenoid valve.

4. The invention of claim 1 or 2 wherein the attenuator comprises a port, and wherein the valve comprises a valve member movable between (1) a closed position, in which the valve member selectively blocks fluid flow in both directions between the pump and the attenuator as well as fluid flow in both directions between the pump and the fuel rail inlet and (2) an open position, in which the valve member selectively allows fluid flow in both directions between the pump and the attenuator and between the pump and the fuel rail inlet.

5. The invention of claim 4 wherein the valve member comprises a tapered needle, and wherein the valve further comprises a valve seat.

6. The invention of claim 5 wherein the valve seat comprises a tapered surface shaped to receive and seal against the tapered needle, and wherein the attenuator port and the fuel rail inlet are in fluid communication with the tapered surface.

7. The invention of claim 6 wherein the valve isolates the attenuator port from the fuel rail inlet when the valve member comprising the needle is in the closed position.

8. The invention of claim 3 wherein the solenoid valve further comprises a spring operative to bias the valve to the closed position.

9. The invention of claim 8 wherein the valve is also operative (1) to selectively block fluid flow in both directions between the pump and the fuel rail inlet when the valve is closed, and (2) to selectively allow fluid flow from the pump to the fuel rail inlet when the valve is opened.

10. The invention of claim 1 wherein the attenuator comprises an expandable pressure vessel comprising a sidewall that is corrugated in cross section to facilitate volumetric expansion of the pressure vessel.

11. A pressure spike attenuator for a fuel injection system for an internal combustion engine, said attenuator comprising:

a valve body comprising an inlet, an outlet, a port, and a valve seat in fluid communication with the inlet, outlet, and port;

an expandable pressure vessel secured to the valve body around the port;

a valve member movable between (1) a closed position, in which the valve member blocks fluid flow through the outlet and the port, and (2) an opened position, in which the valve member allows fluid flow from the inlet to the outlet and the port and from the port to the outlet; and an actuator coupled to the valve member and operative to move the valve member from the closed to the open position.

12. The invention of claim 11 wherein the expandable pressure vessel comprises a sidewall that is corrugated in cross-section to facilitate volumetric expansion of the pressure vessel.

13. The invention of claim 11 wherein the actuator comprises a solenoid coil.

14. The invention of claim 11 wherein the valve member comprises a tapered needle.

15. The invention of claim 14 wherein the valve seat comprises a tapered surface shaped to receive and seal against the tapered needle, and wherein the port and the outlet are in fluid communication with the tapered surface.

16. The invention of claim 15 wherein the valve isolates the port from the outlet when the valve member comprising the needle is in the closed position.

17. The invention of claim 11 further comprising a spring operative to bias the valve to the closed position.

18. The invention of claim 1 wherein the pressure vessel comprises a sidewall that is corrugated in cross section to facilitate volumetric expansion of the pressure vessel.

* * * * *